United States Patent [19]

Gehrig

[11] Patent Number: 4,723,758

[45] Date of Patent: Feb. 9, 1988

[54] SAFETY COVERING FOR GUIDE RAILS

[76] Inventor: Uis W. Gehrig, Box 70, CH 6052 Heigiswie NW, Switzerland

[21] Appl. No.: 782,210

[22] Filed: Sep. 30, 1985

[30] Foreign Application Priority Data

Oct. 9, 1984 [CH] Switzerland ..... 04838/84

[51] Int. Cl.[4] ..... E01F 15/00

[52] U.S. Cl. ..... 256/13.1; 256/1; 404/9

[58] Field of Search ..... 256/13.1, 1; 404/9, 404/6, 16

[56] References Cited

U.S. PATENT DOCUMENTS

| | | | |
|---|---|---|---|
| 4,000,882 | 1/1977 | Penton | 256/13.1 |
| 4,222,552 | 9/1980 | Matteo, Sr. | 256/13.1 |
| 4,224,002 | 9/1980 | Heenan et al. | 256/13.1 X |
| 4,354,772 | 10/1982 | Drexler | 256/13.1 X |

FOREIGN PATENT DOCUMENTS

| | | | |
|---|---|---|---|
| 1917931 | 10/1970 | Fed. Rep. of Germany | 256/13.1 |
| 2416303 | 10/1979 | France | 256/13.1 |
| 2460365 | 2/1981 | France | 256/13.1 |
| 194790 | 3/1965 | Sweden | 256/13.1 |

*Primary Examiner*—Andrew V. Kundrat
*Attorney, Agent, or Firm*—Darby & Darby

[57] ABSTRACT

A safety covering for guide or guard rails has a plastic element of bright material. Besides a contour corresponding to the guide rail front side to be covered, tabs for engaging the guide rail edges from behind are provided at the longitudinal edges. A special reflecting insert can augment the optical effect. Signal surfaces applied additionally on the safety coverings at an angle of less than 90° can impart further optical information to drivers. By local application of such safety coverings on guide rails, optical traffic guidance can be enhanced and easily modified.

4 Claims, 4 Drawing Figures

SAFETY COVERING FOR GUIDE RAILS

BACKGROUND OF THE INVENTION

The present invention broadly relates to a safety covering for highway guard rails. More specifically, the present invention pertains to a new and improved safety covering or safety covering element for highway guard rails.

Guide rails, or highway guard rails, are fence-like means of protection and guidance extending along the side of a highway or roadway in substantially upright position for preventing a vehicle from veering off the roadway. At the same time the guard rail serves as an optical traffic guide; the motorist uses the guard rail to help determine the direction of the roadway. Such guard rails are presently made mainly of steel, an especially wide-spread form being a configuration of two longitudinal bulges disposed one above the other on the roadway face of the guard rail between the longitudinal edges thereof. Thus, the guard rail is substantially W-shaped in cross section and includes a U-shaped trough, facing the roadway.

Often highway guard rails can fulfill their optical function only for a short period of time, since dirt and weathering soon renders them unable to reflect light any more. As far as they remain visible at all, they have a monotonous appearance or are optically so in conspicuous that accidents are less effectively averted as a result of the diminished optical reflectivity of the guard rails.

SUMMARY OF THE INVENTION

Therefore, with the foregoing in mind, it is a primary object of the present invention to provide a new and improved construction of a safety covering or safety covering element for highway guard rails which does not exhibit the aforementioned drawbacks and shortcomings of the prior art constructions. Another and more specific object of the present invention is to provide a highway guard having an improved or augmented optical traffic guiding function in an economically advantageous manner.

A further significant object of the present invention is to provide a new and improved construction of a safety covering or safety covering element of the previously mentioned type which is simple in construction and design, economical in fabrication, reliable in service and requires a minimum amount of maintenance and attention.

Now in order to implement these and still further objects of the invention, which will become more readily apparent as this description proceeds, the safety covering or safety covering elementn of the present invention is manifested by a substantially longitudinal body member having a transverse profile and two longitudinal edges extending in substantially parallel relationship; the body member comprising a resilient, dirt repellent, light-reflective material; the body member being provided at each of the two longitudinal edges thereof with positive engagement means for engaging over the mutually parallel longitudinal edges or the guard rail and thereby fastening the body member ot the guard rail; and the transverse profile of the body member being adapted to the predetermined transverse profile of the guard rail such that the body member conforms to the outer face of the guard rail and the engagement means snap over the guard rail with a pre-loading effect.

The safety covering according to the invention can be manufactured in elements of manageable length.

A safety covering according to the invention can be mounted on old or new guard rails section by section, it being able to thus improve or alter the local light reflection properties. This permits achieving good visibility while avoiding danger of disorientation or confusion in traffic.

A weather resistant, cheap plastic is preferably employed, such as suitable thermoplasts, which may advantageously be dyed in a bright color, especially white.

Plastic or synthetic safety covering elements which are elastically deformable or resilient to the extent that they can be snapped onto the guide or guard rail from the roadway side are especially easy to apply.

In addition to good light reflection by the bright or white color, intensive reflection of light ca occur in particular zones, and this can considerably promote distinguishing the guide or guard rail from its optical background. For this purpose a zone can be provided, for example in the center of a safety covering element, which reflects especially intensively or in luminous colors or both. Such a zone may be recessed in the plastic, thereby promoting durability. This intensification of light reflection can be achieved by known means such as glass balls, triple or so-called corner reflectors, etc.

The safety covering of the present invention is especially well suited for the most common guard rail form or configuration mentioned above since the shape can be economically fabricated.

Hence, the invention offers the possibility, by local application of safety covering elements according to the invention on guard rails, of rendering optical traffic conduction or guidance at least more readily distinguishable. The safety covering elements can be not only especially dirt-repellent and weather-resistant, but also more amenable to cleaning or replacement, or both, then the guard rails themselves.

By suitable choice of color ad other patterning of the safety covering elements, a further influence on traffic is possible, e.g. by applying shorter and shorter elements at closer and closer intervals, it is possible to artificially simulate an apparently increasing speed before curves, intersections and other danger points, or to create other signals, e.g. for alerting motorists traveling the wrong-way, to the fact that they have erroneously entered the wrong lane and are steering their vehicle counter to the permissible travel direction.

BRIEF DESCRIPTION OF THE DRAWINGS

The invention will be better understood and objects other than those set forth above will become apparent when consideration is given to the following detailed description thereof. The description makes reference to the annexed drawings, wherein.

DETAILED DESCRIPTION OF THE PREFERRED EMBODIMENT

Figure 1:
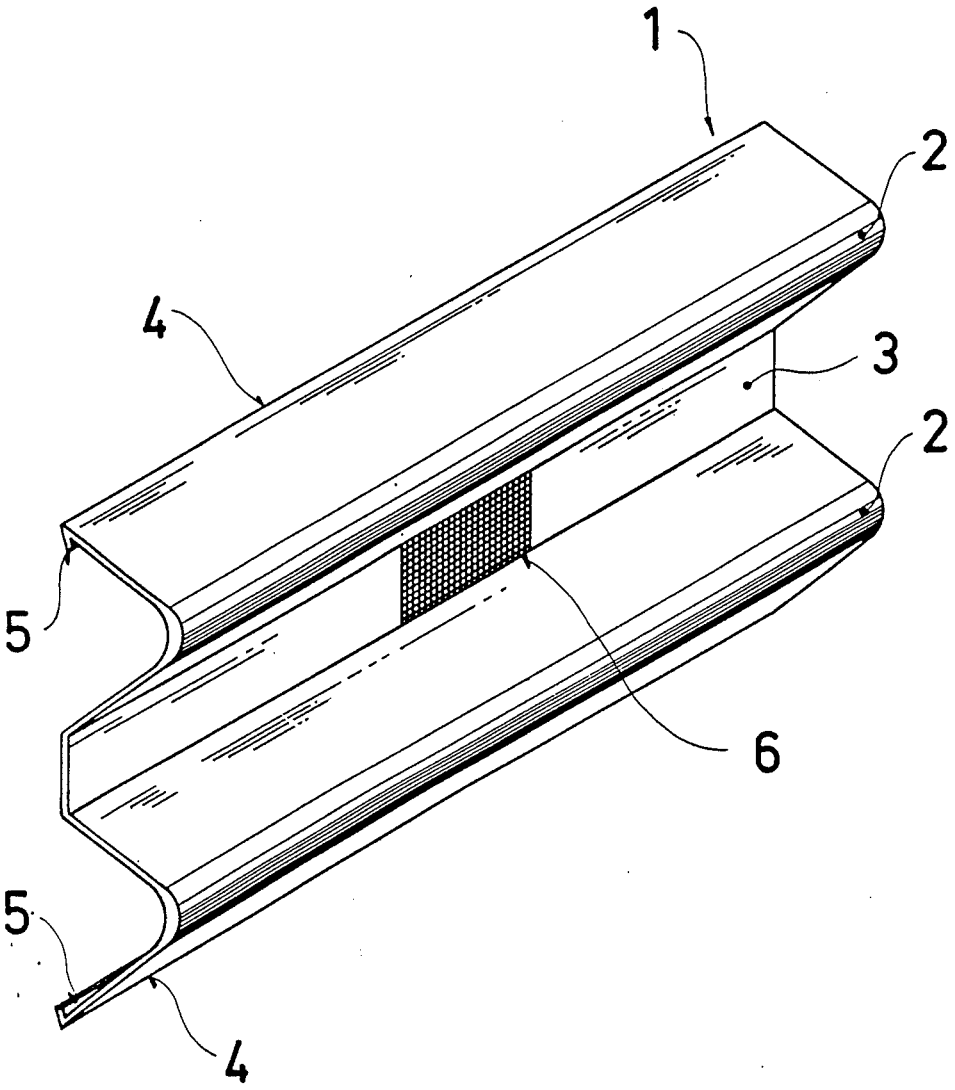
FIG. 1 schematically illustrates a portion of a safety covering element according to the invention in isometric view.

Describing now the drawings, it is to be understood that to simplify the presentation thereof only enough of the structure of the safety covering or safety covering element of the present invention has been illustrated as is needed to enable one skilled in the art to readily understand the underlying principles and concepts of this invention. Turning now specifically to FIG. 1 of the drawings, the structure illustrated therein by way of example and not limitation will be seen to comprise a safety covering element 1 having a form or profile which corresponds to that of the most common guard rail profiles, where two bulges 2 protruding forward toward the roadway are separated by groove 3. along the longitudinal edges 4 rearwardly bent holding parts 5 are provided, which can engage the guard rail edges from behind.

The preferably plastic safety covering element 1 can be snapped onto the guard rail from the front, with elastic deformationn or resiliency.

In the center of the groove 3 is an especially highly reflective zone or zoen of higher albedo 6, which lies on or is embedded in the plastic safety covering element 1. It can also contrast in color with the preferably white color of the safety covering element.

Figure 2:
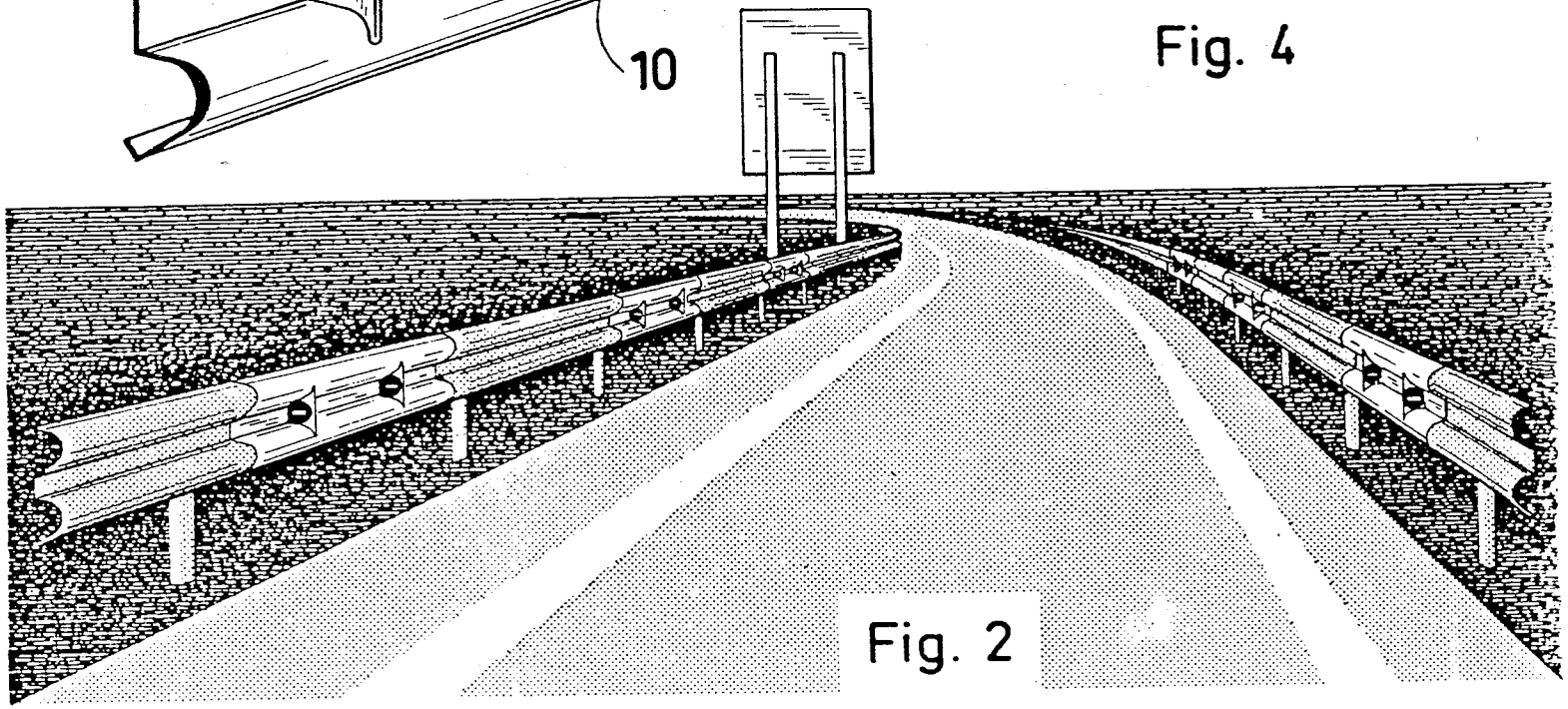
FIG. 2 schematically represents a nocturnal perspective of a highway ramp fitted with guard rails bearing safety covering elements according to the invention.

In FIG. 2, a highway exit is represented from the perspective of a wrong-way driver. On the guard rails on both sides, groups of three safety coverings, each with two signal surfaces 10 which are inclined less than 90° to the travel direction of the wrong-way driver and bear one-way or do-not-enter signs or symbols, are visible for alerting the driver to this dangerous mistake.

Figure 4:
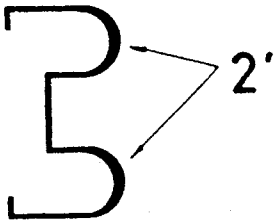
FIG. 4 is a schematic cross-section of the safety covering element of FIG. 1 in an initial free state.
Figure 3:
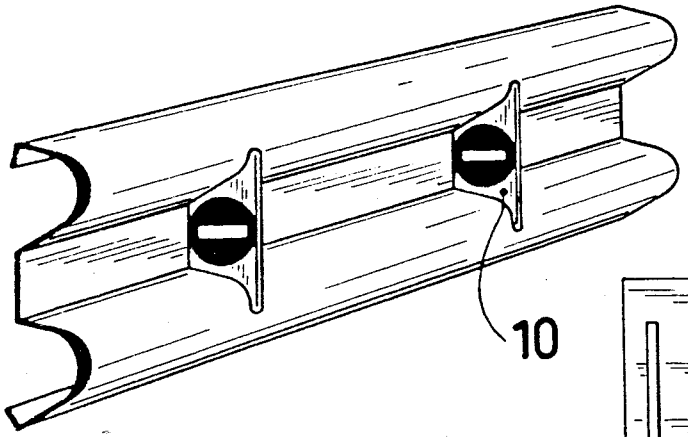
FIG. 3 schematically illustrates a modified embodiment of the safety covering element according to FIG. 1.

In FIG. 3, a single safety covering element 1 having two signal surfaces 10 is shown as an enlarged detail of FIG. 2, and finally in FIG. 4 the transverse section of an unstressed safety covering element 1 is shown. A gradual local thickening 2' of the bulge 2 will be apparent.

According to the invention, these thickened areas 2' of the bulge 2 serve in the sense of an archer's bow tensioned the wrong way after completed installation for the attachment of the safety covering element 1 on the guide rail, i.e. as a springing or pre-loading measure.

I claim:

1. Guard rail safety covering for mounting to a generally W-shaped guard rail having a generally U-shaped trough, said guard rail positioned along an edge of a roadway, comprising:

a generally W-shaped, reflective, resilient member, having a generally U-shaped trough;

fastening means for securing said resilient member to said guard rail; and reflective element means mounted within said U-shaped trough, at an angle which reflects light at one traveling said roadway, said reflective element means including reflective graphic indicia representative of highway road signs.

2. The safety covering of claim 1 wherein said fastening means is selected from the group consisting of clamps, screws, bolts, rivets and snaps.

3. The safety covering of claim 1 wherein said resilient member further includes inwardly directed flanges along each longitudinal edge.

4. The safety covering of claim 3 wherein said fastening means include deforming said resilient member to snap into position over said guard rail, such that said inwardly directed flanges hold said resilient member in place.

* * * * *